US006746382B2

(12) United States Patent
Harrison

(10) Patent No.: US 6,746,382 B2
(45) Date of Patent: Jun. 8, 2004

(54) QUADRICEP ISOLATION EXERCISE APPARATUS

(76) Inventor: David Beal Harrison, 750 N. Delaware Ave., Deland, FL (US) 32720

( * ) Notice: Subject to any disclaimer, the term of this patent is extended or adjusted under 35 U.S.C. 154(b) by 111 days.

(21) Appl. No.: 09/947,579

(22) Filed: Jan. 8, 2002

(65) Prior Publication Data

US 2003/0130097 A1 Jul. 10, 2003

(51) Int. Cl.[7] ..... A63B 21/02
(52) U.S. Cl. ..... 482/122; 482/126; 482/100
(58) Field of Search ..... 482/121–123, 482/126, 907, 137, 112, 125, 129, 135, 145, 100

(56) References Cited

U.S. PATENT DOCUMENTS 5,616,109 A * 4/1997 Szu-Ming 5,616,111 A * 4/1997 Randolph

* cited by examiner

*Primary Examiner*—Jerome W. Donnelly
(74) *Attorney, Agent, or Firm*—Allen, Dyer, Doppelt, Milbrath & Gilchrist, P.A.

(57) ABSTRACT

A portable quadriceps exercise device includes at least one static arm; a pair of knee support pads connected to opposite respective sides of the at least one static arm; a foundation arm having a first end pivotally connected to a first end of the at least one static arm; and a stabilization arm having a first end pivotally connected to a second end of the at least one static arm. A handle is connected to the second end of the stabilization arm so that a user may grasp the handle to maintain stability of the device during use. The device may also include a pivot arm having a first end of the pivot arm being pivotally connected to the second end of the at least one static arm; a pair of ankle pads connected to opposite respective sides of the pivot arm adjacent the second end thereof; and at least one resistance element operatively connected between the at least one static arm and the pivot arm.

14 Claims, 7 Drawing Sheets

QUADRICEP ISOLATION EXERCISE APPARATUS

FIELD OF THE INVENTION

The present invention relates to the field of exercise equipment and, more particularly, to exercise equipment for the quadriceps muscles of the leg.

BACKGROUND OF THE INVENTION

Exercise equipment exists for many muscles of the human body. What is desired for some applications is a device to provide specific exercise of the quadriceps muscles as a primary focus and with zero impact. It may also be desired to permit the user to exercise this group of muscles in a fairly complete range of motion—from a flex of 90 degrees or slightly more. It may also be desired that there is no jarring during its use in terms of impact on the knee joint, and that there is no direct pressure vertical on the knee joint. It may be desired that such an exercise apparatus be useable by individuals who may not be ambulatory because of chronically weak leg muscles. The apparatus may also preferably be configured so that it can be set up while a person is confined to bed recovering from an illness or accident where measured resistance is essential to decisions as to when ambulation efforts would be safe.

SUMMARY OF THE INVENTION

In view of the foregoing background it is therefore an object of the present invention to provide a portable exercise apparatus for the quadriceps that does not jar the knee joint, and that may be suitable for users who are not ambulatory.

These and other objects, features and advantages in accordance with the present invention are provided by a portable quadriceps exercise apparatus comprising at least one static arm; a pair of knee support pads connected to opposite respective sides of the at least one static arm; a foundation arm having a first end pivotally connected to a first end of the at least one static arm; and a stabilization arm having a first end pivotally connected to a second end of the at least one static arm. A handle may be connected to the second end of the stabilization arm so that a user may grasp the handle to maintain stability of the apparatus during use. The apparatus may also include a pivot arm having a first end being pivotally connected to the second end of the at least one static arm; a pair of ankle pads connected to opposite respective sides of the pivot arm adjacent the second end thereof; and at least one resistance element operatively connected between the at least one static arm and the pivot arm.

The at least one static arm may comprise a pair of spaced apart static arms. The foundation arm may also be movable between a collapsed position adjacent the at least one static arm and an extended operating position. The pair of knee support pads may be connected to a medial portion of the at least one static arm. Accordingly, the quadriceps exercise apparatus may be collapsible for easy storage and portability.

The foundation arm may be pivotally connected to the first end of the at least one static arm and may be movable between a collapsed position adjacent the static arm and an extended operating position. In the extended operating position, the foundation arm may be positioned against the floor. The apparatus may further comprise a locking pin for permitting selective locking of the foundation arm in the extended operating position.

The resistance element may comprise at least one elastic member. The apparatus may further comprise a cover adjacent the elastic member in case of failure thereof.

DETAILED DESCRIPTION OF THE PREFERRED EMBODIMENTS

The device 20 is designed to exercise the quadriceps muscles of the human leg as a primary target. It is portable. It may be used while sitting in almost any conventional chair. Resistance is provided by stretching an elastic element between two posts by extending the legs. The current model is constructed of fiberglass stainless steel fittings.

The device 20 was designed to provide specific exercise of the quadriceps muscles as a primary focus and with zero impact. It permits the user to exercise this group of muscles in a fairly complete range of motion—from a flex of 90 degrees or slightly more, depending on the pin setting. There is no jarring during its use in terms of impact on the knee joint. There is no direct pressure vertical on the knee joint. It is designed to be utilized by individuals who may not be ambulatory because of chronically weak leg muscles. The foundation arm 50 may be positioned such that the device 20 can be set up while a person is confined to bed recovering from an illness or accident where measured resistance is essential to decisions as to when ambulation efforts would be safe.

Figure 4A:
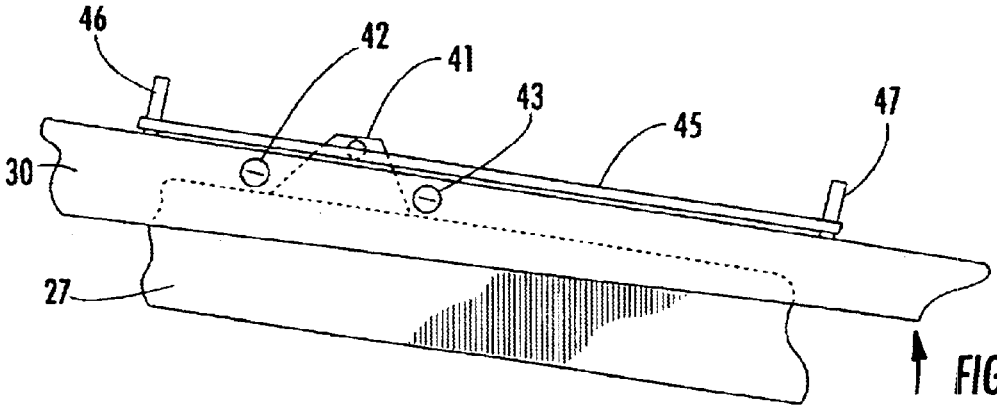
FIGS. 4A and 4B are a greatly enlarged side elevational views of a portion of the apparatus as shown in FIG. 1.
Figure 4B:
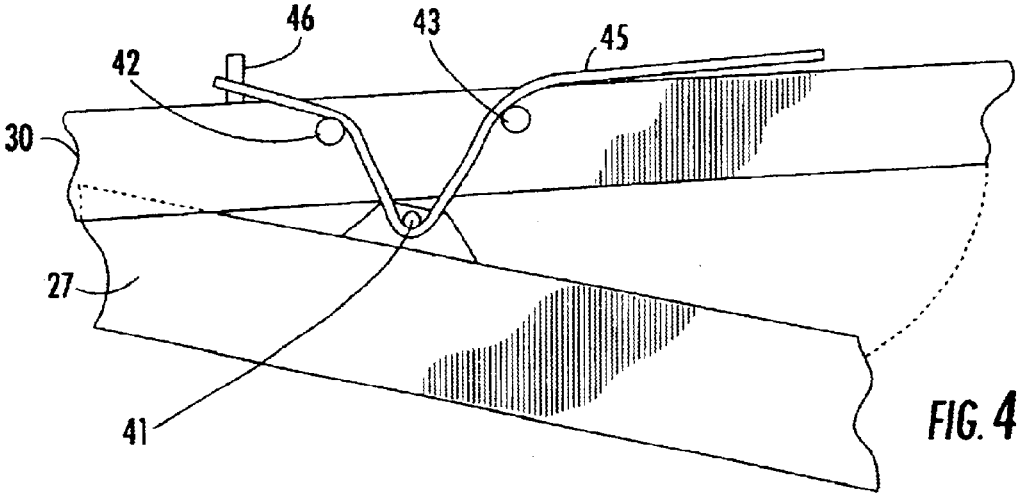

Referring now initially to FIGS. 1–4B, components of the apparatus 20 are now described. The handle assembly 22 includes two handle grips 23 over an aluminum tube 24. The aluminum tube 24 is attached to the stabilization arm 25. This arm 25 swings out from the containment area in the device 20 to any position considered comfortable by the user to ensure that the top and bottom of the device remain stable. The stabilization arm 25 is located between the two static arms 27. The two static arms 27 are positioned between the wings of the pivot arm 30. Passing through the two static arms is a ¾ inch diameter aluminum rod 33 upon which foam rubber knee support pads 34 rotate. Attached to the pivot arm 30 (bottom portion) is a ¾ inch diameter aluminum rod 36 upon which foam rollers 37 rotate for ankle support. Hinged to the pivot arm 30 is the elastic resistance failure safety cover 40. This component 40 is designed to contain the elastic resistance 45 which may break away from one of two anchor arms 46, 47 as illustrated in FIGS. 4A and 4B. Passing through both static arms 27 is a stainless-steel pin with a bronze sleeve 41 which is a rolling base for the elastic resistance 45. Located on the pivot arm 30 are two stainless steel pins with bronze sleeves 42, 43 to provide rolling surfaces for elastic resistance 45 which is anchored on the top and bottom anchors 46, 47 (FIGS. 4A and 4B).

The foundation arm 50 is attached to the static arms 27 with a stainless steel shaft 51. The foundation arm 50 may be adjusted to various positions with the lockout pin 52. The stabilization arm 25 is connected to the pivot arm 30 and static arm 27 by a pin 39.

FIGS. 4A and 4B illustrate how the resistance 45 functions. The elastic resistance 45 is attached to bottom anchor arm 47, guided over the bottom bronze sleeved elastic roller 43 on the pin-pivot arm 30 down to the static arm 27 bronze sleeved elastic roller pin 41, and to the top bronze sleeved elastic roller pin 42 on the pivot arm 30 and then attached to the upper anchor arm 46. As the pivot arm 30 is moved away from the static arm 27 the elastic resistance 45 rolls over the bronze sleeved roller pins 41–43 and stretches in order to provide resistance. Multiple bands may be placed within the designated points to provide greater resistance.

Figure 1:
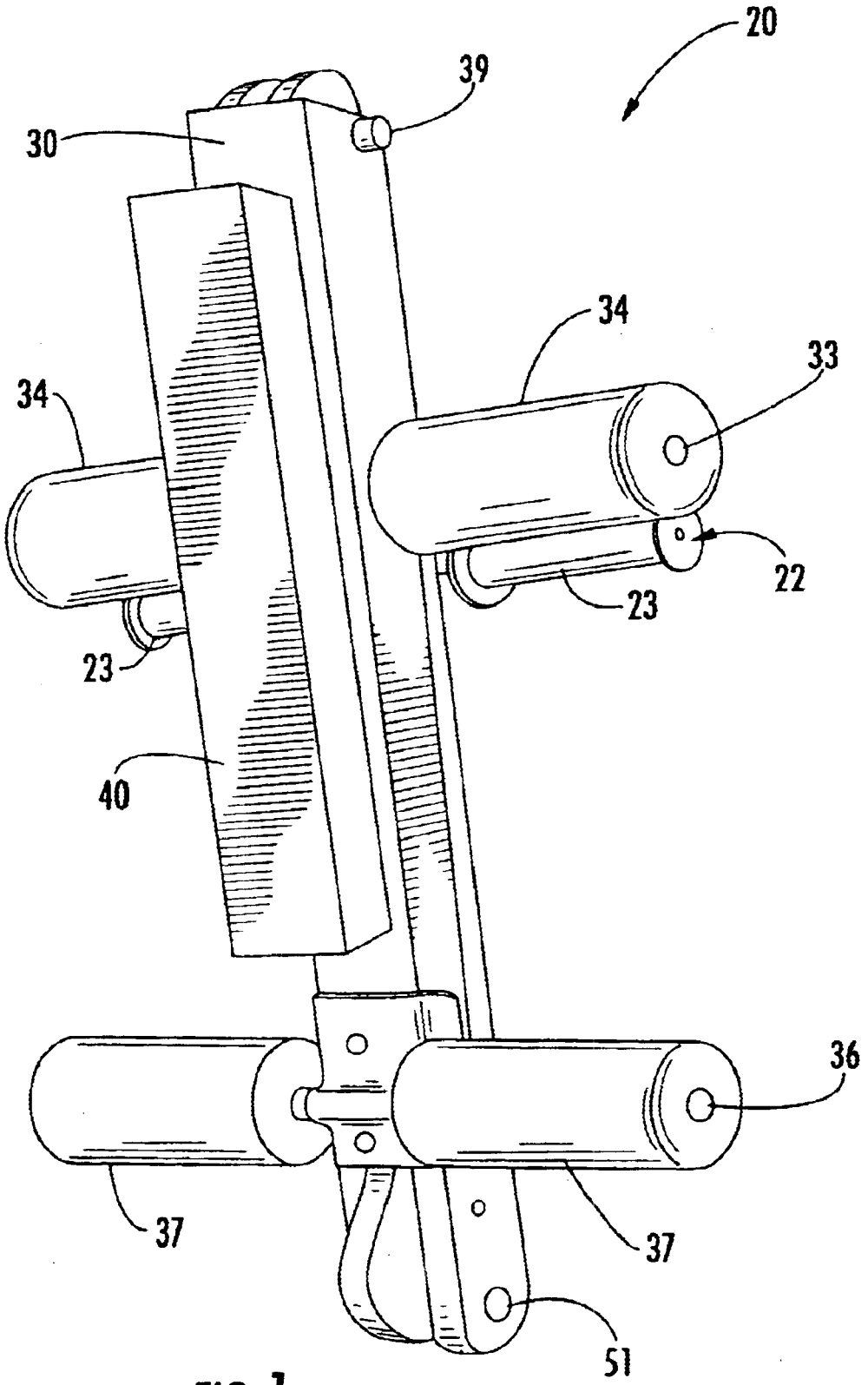
FIG. 1 is a perspective view of the exercise apparatus in accordance with the present invention in the collapsed position.
Figure 2:
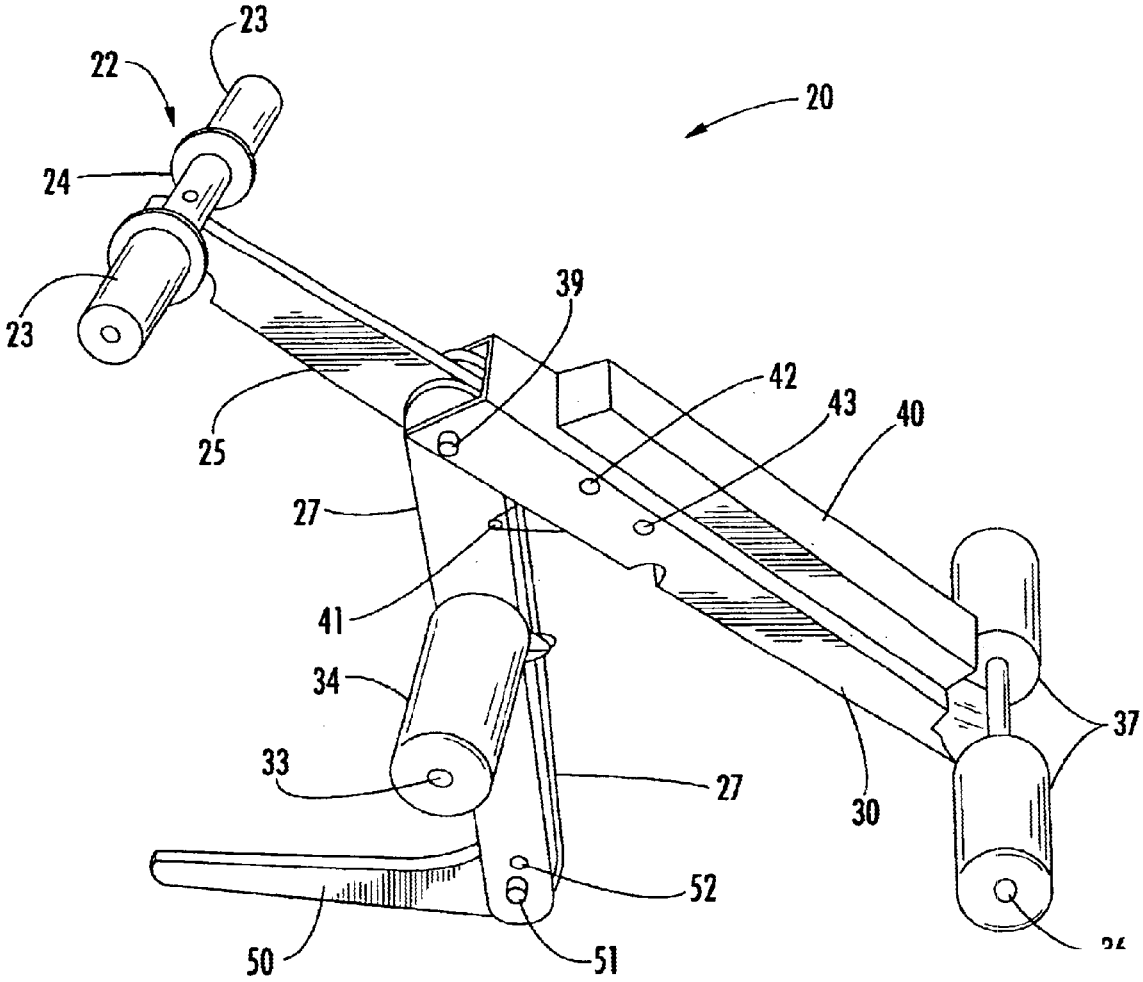
FIG. 2 is a perspective view of the apparatus as in FIG. 1 in an operating or open position.
Figure 3:
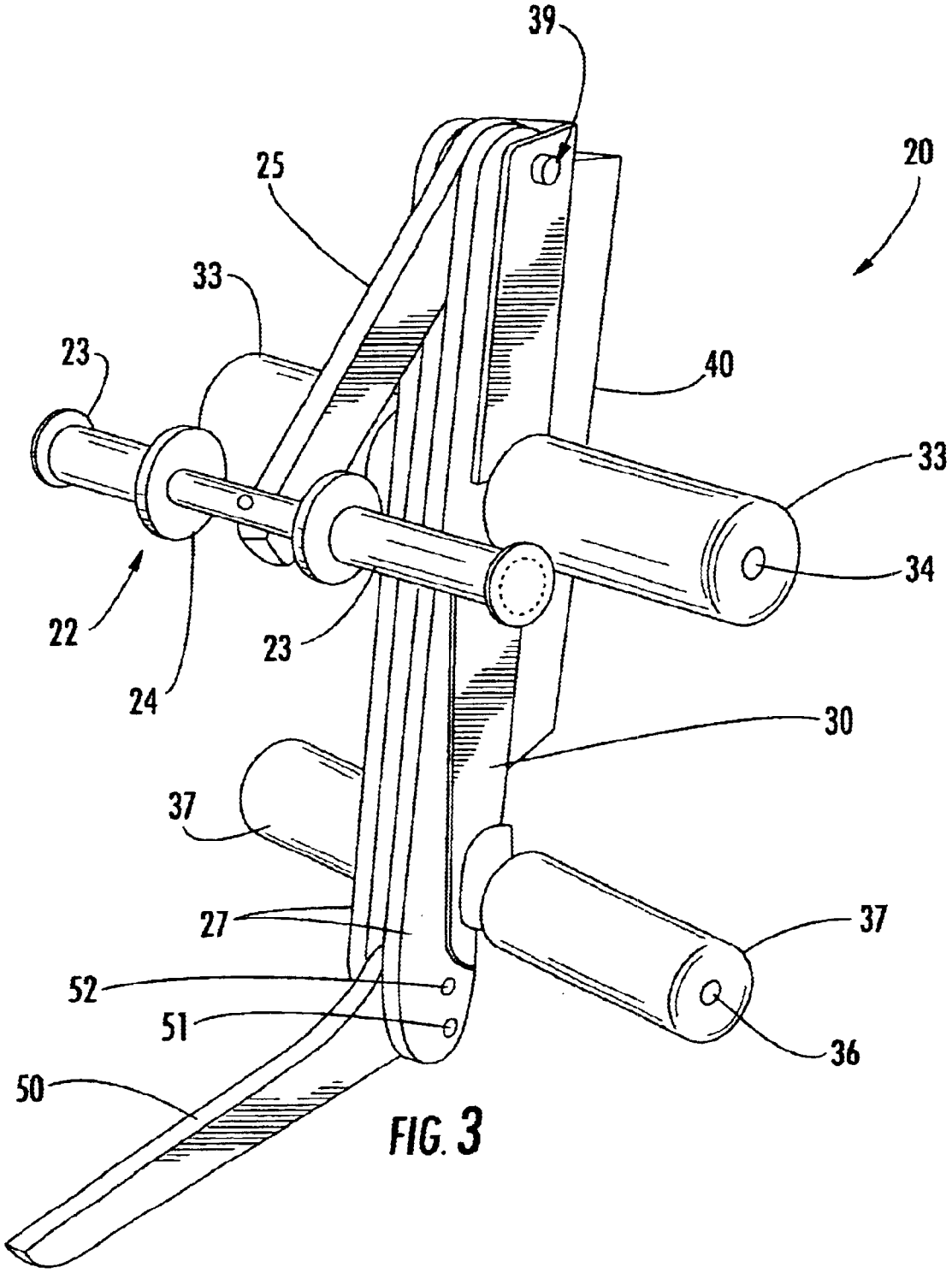
FIG. 3 is a perspective view of the apparatus as shown in FIG. 1 in a partially opened position.
Figure 5:
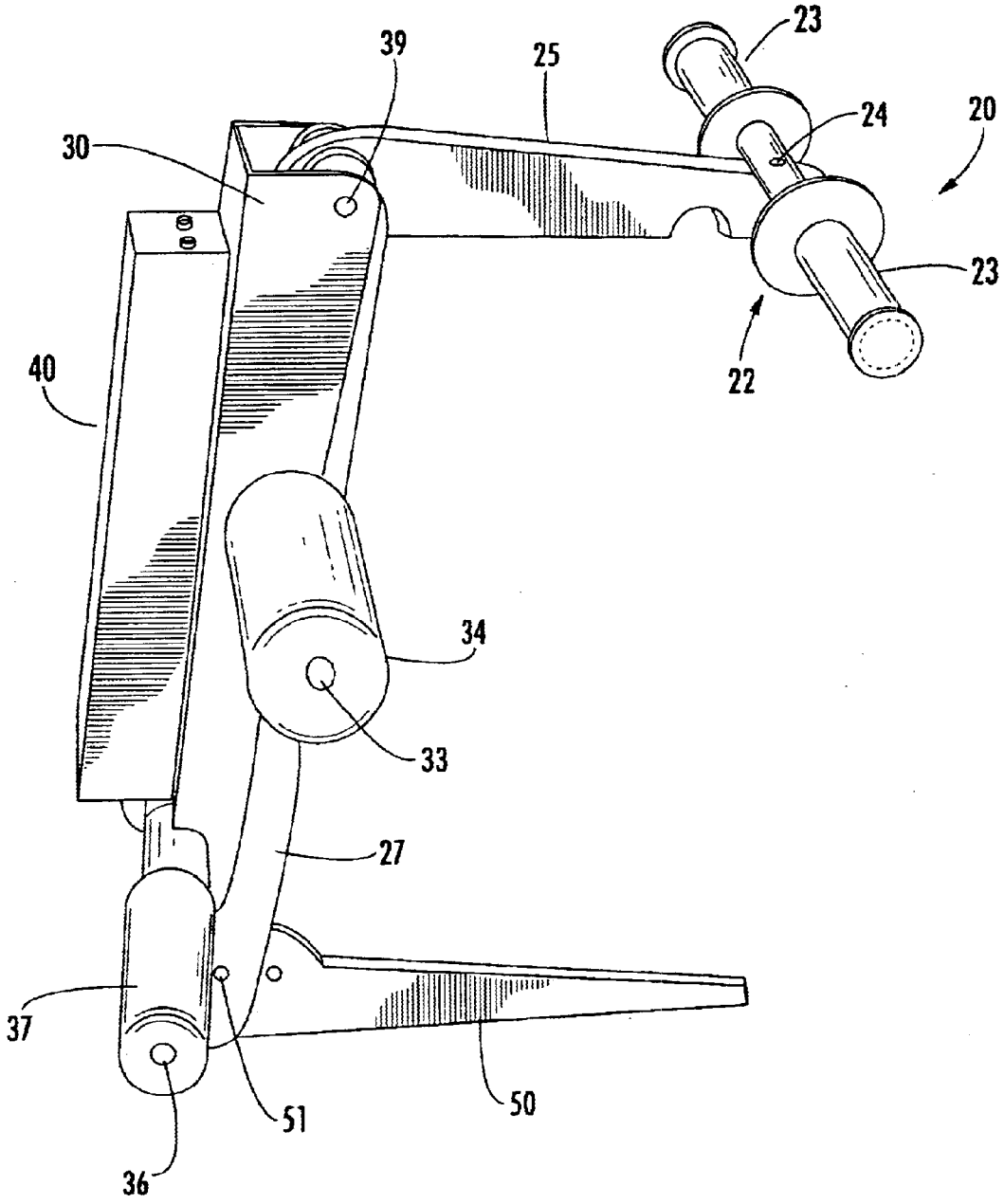
FIG. 5 is a perspective view of the apparatus as shown in FIG. 1 in an initial position prior to use by a user.
Figure 6:
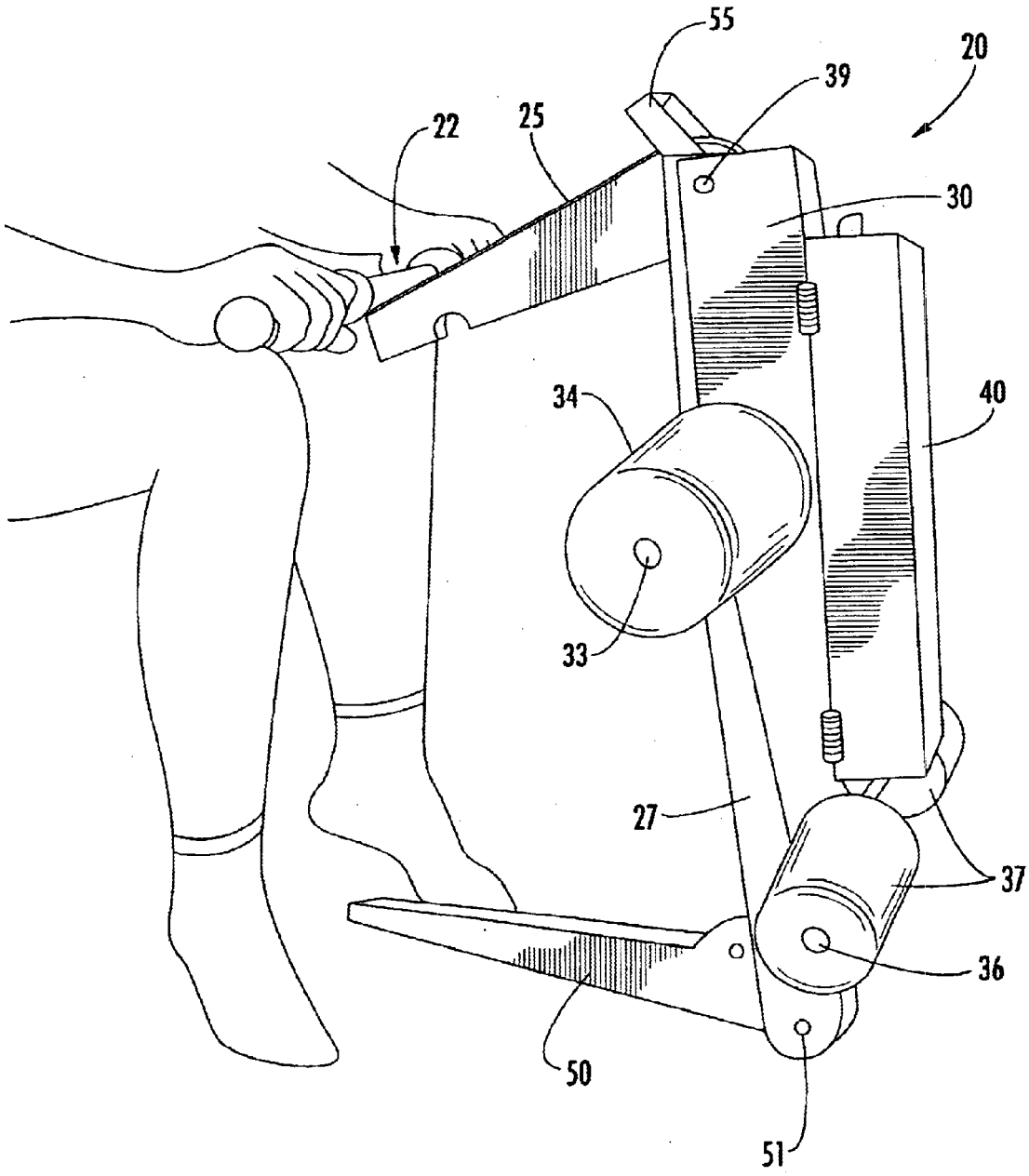
FIG. 6 is a perspective view of the apparatus as shown in FIG. 6 and illustrating initial positioning by the user.

FIG. 5 illustrates the appearance of the machine 20 from the left side. The machine 20 is symmetrical in its components. FIG. 6 illustrates an individual in a sitting position opening the machine 20 out from its closed position as indicated in FIG. 1. The individual has gripped the two handles 23. On the top of the machine 20 is an optional handle 55 for toting. The individual will slide the machine 20 back between the legs as they sit on a chair after he has inserted the lockout pin 52 to maintain the foundation arm 50 in the desired position. The individual will place each leg over the roller padded knee supports 34 on both sides and feet under the roller padded ankle supports 37 on each side.

Figure 7:
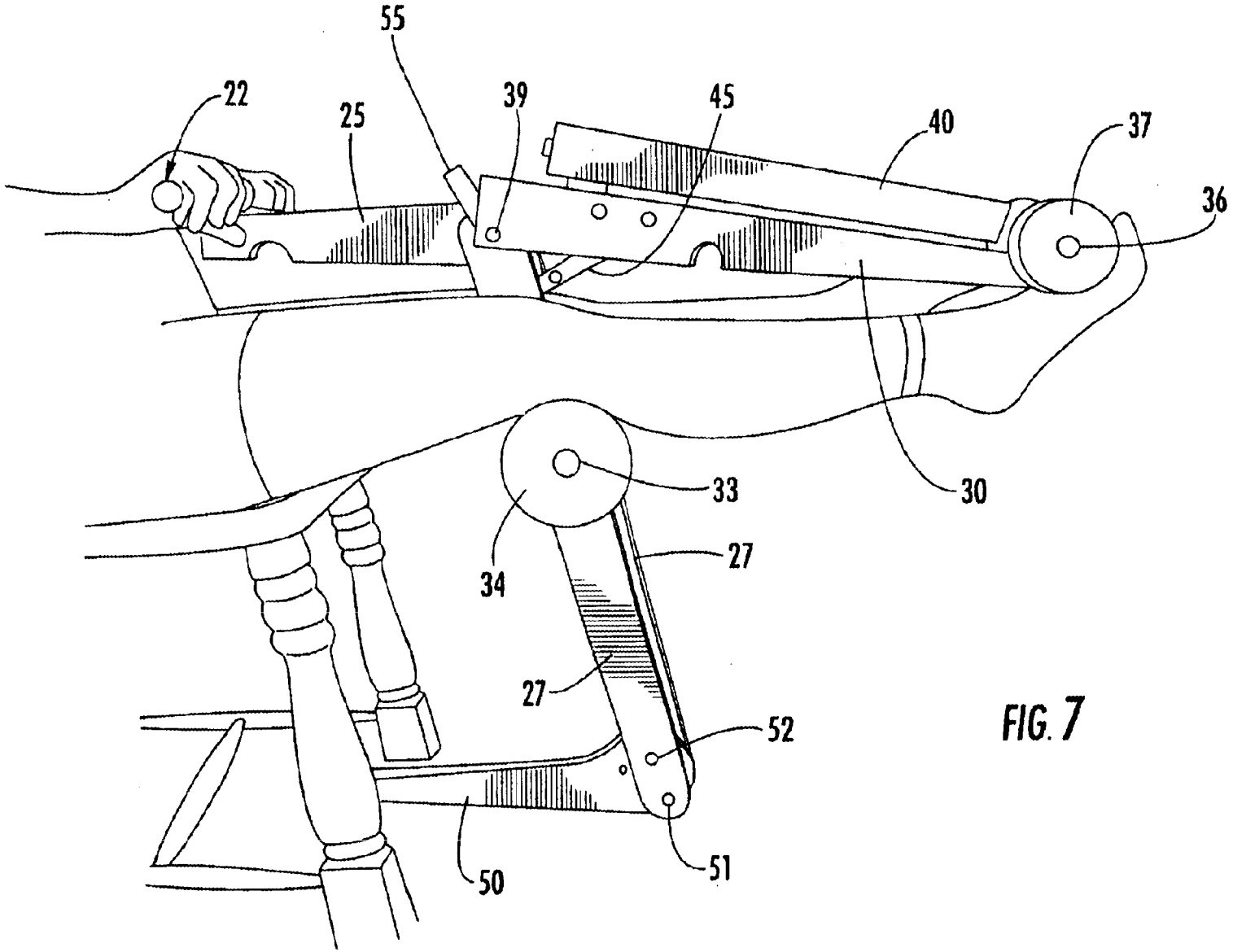
FIG. 7 is a perspective view of the apparatus as shown in FIG. 6 and illustrating a fully extended position during exercise by the user.

FIG. 7 illustrates the action involved during the exercise. The individual raises the pivot arm 30 away from the static arms 27 by extending their legs and thus stretching the elastic resistance 45 in the process. The stabilization arm 25 is held firmly at a recommended position parallel to the floor or possibly higher. The individual slowly moves the pivot arm 30 through a 90 degree range of motion away from the static arms 27 and foundation arm 50.

The individual disengages from the device 20 after each set. This is accomplished by swinging the ankles from the ankle pads 37 and lifting the knees off the knee support pads 34 while maintaining a grip on the handles 23 attached to the stabilization arm 25.

As the individual exercises he will note a primary contraction occurring in the distal third of the quadriceps group of muscles and eventually the entire length of the group. The biceps femoris will also contract as well as the tibialis anterior. Other muscle contractions will also be noted.

Upon completion of the desired amount of exercise, the individual will fold up the apparatus as indicated in FIG. 1.

This exercise apparatus 20 was developed to permit exercise of the upper legs—quadricep group of muscles—from a number of seated conventional locations such as typical chairs, etc. The apparatus user would sit in a chair, unfold the device 20 (FIG. 6), engage it as illustrated in FIG. 7, and initiate the exercise routine by setting the resistance as noted on elastic resistance (10–15–20-lbs—or up to 100 lbs). The user would then extend the legs through a tolerable range of motion up to 90 degrees for multiple repetitions 20 to 50 for aerobics (light resistance) or 8 to 15 for heavy resistance. There would be low to no joint impact if the device 20 is used correctly with smooth movement and reasonable rest between sets of repetitions. The device 20 will fold completely and is light weight enough to be easily portable.

Typical quadriceps machines utilize weights on sliding tracks which are bolted to large steel frames. Resistance changes require movement to the weight rack. These devices are clearly not portable except within limits and with the use of assistance of other persons and sometimes equipment. Other leg exercise devices which may employ elastic resistance also require heavy steel framework and are designed to provide a number of different leg exercise routines without specific primary focus on the quadriceps muscles in isolation from the significant-use of other leg muscles such as the gluteus group and bicep femoris as would occur with the leg press.

That which is claimed is:

1. A portable quadricep exercise apparatus comprising:

at least one static arm having opposing first and second ends;

a pair of knee support pads connected to opposite respective sides of said at least one static arm;

a foundation arm having a first end pivotally connected to the first end of said at least one static arm;

a stabilization arm having opposing first and second ends, the first end of said stabilization arm being pivotally connected to the second end of said at least one static arm;

a handle connected to the second end of said stabilization arm;

a pivot arm having opposing first and second ends, the first end of said pivot arm being pivotally connected to the second end of said at least one static arm;

a pair of ankle pads connected to opposite respective sides of said pivot arm adjacent the second end thereof; and at least one resistance element operatively connected between said at least one static arm and said pivot arm.

2. A portable quadriceps exercise apparatus according to claim 1 wherein said at least one static arm comprises a pair of spaced apart static arms.

3. A portable quadriceps exercise apparatus according to claim 1 wherein said stabilization arm is movable between a collapsed position adjacent said at least one static arm and an extended operating position.

4. A portable quadriceps exercise apparatus according to claim 1 wherein said pair of knee support pads are connected to a medial portion of said at least one static arm.

5. A portable quadriceps exercise apparatus according to claim 1 further comprising a cover adjacent said at least one resistance element.

6. A portable quadriceps exercise apparatus according to claim 1 wherein said foundation arm is pivotally connected to the first end of said at least one static arm and is movable between a collapsed position adjacent said at least one static arm and an extended operating position.

7. A portable quadriceps exercise apparatus according to claim 6 further comprising a locking pin for permitting selective locking of said foundation arm in the extended operating position.

8. A portable quadriceps exercise apparatus according to claim 1 wherein said resistance element comprises at least one elastic member.

9. A portable quadricep exercise apparatus comprising:

a pair of static arms having opposing first and second ends;

a pair of knee support pads connected to opposite respective sides of said pair of static arms;

a foundation arm having a first end pivotally connected to the first end of said pair of static arms;

a stabilization arm having opposing first and second ends, the first end of said stabilization arm being pivotally connected to the second end of said pair of static arms;

a handle connected to the second end of said stabilization arm;

a pivot arm having opposing first and second ends, the first end of said pivot arm being pivotally connected to the second end of said pair of static arms;

a pair of ankle pads connected to opposite respective sides of said pivot arm adjacent the second end thereof; and at least one elastic element operatively connected between said pair of static arms and said pivot arm.

10. A portable quadriceps exercise apparatus according to claim 9 wherein said stabilization arm is movable between a collapsed position adjacent said pair of static arms and an extended operating position.

11. A portable quadriceps exercise apparatus according to claim 9 wherein said pair of knee support pads are connected to a medial portion of said pair of static arms.

12. A Portable quadriceps exercise apparatus according to claim 9 further comprising a cover adjacent said at least one elastic element.

13. A portable quadriceps exercise apparatus according to claim 9 wherein said foundation arm is pivotally connected to the first end of said pair of static arms and is movable between a collapsed position adjacent said pair of static arms and an extended operating position.

14. A portable quadriceps exercise apparatus according to claim 13 further comprising a locking pin for permitting selective locking of said foundation arm in the extended operating position.

* * * * *